US008567901B2

(12) United States Patent
Tanaka et al.

(10) Patent No.: US 8,567,901 B2
(45) Date of Patent: Oct. 29, 2013

(54) LIQUID EJECTING APPARATUS

(75) Inventors: Daisuke Tanaka, Shiojiri (JP); Takafumi Ogimura, Shiojiri (JP); Minoru Kishigami, Matsumoto (JP); Kazuyoshi Ohashi, Matsumoto (JP); Shota Mizuno, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/600,689

(22) Filed: Aug. 31, 2012

(65) Prior Publication Data

US 2013/0050335 A1 Feb. 28, 2013

(30) Foreign Application Priority Data

Aug. 31, 2011 (JP) ..... 2011-188624

(51) Int. Cl.
*B41J 2/165* (2006.01)
*B41J 25/308* (2006.01)

(52) U.S. Cl.
CPC ..... *B41J 2/16511* (2013.01); *B41J 25/308* (2013.01); *B41J 2002/16576* (2013.01)
USPC ..... 347/32; 347/8

(58) Field of Classification Search
CPC ..... B41J 25/308; B41J 2/16511
USPC ..... 347/8
See application file for complete search history.

(56) References Cited

U.S. PATENT DOCUMENTS

2002/0101463 A1* 8/2002 Fairchild et al. ..... 347/8
2003/0025755 A1* 2/2003 Baxter et al. ..... 347/29
2003/0081022 A1* 5/2003 Lim et al. ..... 347/8
2004/0246284 A1* 12/2004 Murai et al. ..... 347/8
2009/0262160 A1* 10/2009 Okuda et al. ..... 347/16

FOREIGN PATENT DOCUMENTS

JP 08-090782 4/1996

* cited by examiner

*Primary Examiner* — Shelby Fidler
(74) *Attorney, Agent, or Firm* — Workman Nydegger

(57) ABSTRACT

An ink jet printer includes a movable carriage supporting a recording head, a cam member adjusting the height position of the carriage to adjust the distance between the paper and the recording head, a cap member that can abut the recording head, and an engagement member that can engage with the carriage in a case where the carriage moves from a printing area to a head opposing position. The cam member adjusts the height position of the carriage when the distance between the paper and the recording head is between a first distance in which the carriage does not engage with the engagement member and a second distance in which the carriage engages with the engagement member. The carriage is decelerated while moving, and the deceleration timing is earlier for the second distance than for the first distance.

9 Claims, 13 Drawing Sheets

LIQUID EJECTING APPARATUS

BACKGROUND

1. Technical Field

The present invention relates to a liquid ejecting apparatus such as, for example, an ink jet printer.

2. Related Art

Generally, an ink jet printer is widely known as a liquid ejecting apparatus ejecting a liquid on a target. With the ink jet printer, printing is performed by ejecting ink (liquid) toward paper (target) from nozzles on a recording head (liquid ejecting head).

With such a printer, since the moisture of the ink within nozzles evaporates through nozzle openings, the viscosity of the ink within the nozzles tends to increase, blocking the nozzles. The blocking of the nozzles is suppressed by performing, periodically during printing, flushing in which the ink within the nozzles is forcibly discharged into a cap member or performing capping in which the cap member abuts the recording head to surround the nozzles during printing rest and during non-use.

Furthermore, the printer shown in JP-A-8-90782 is known in the related art as a printer including such a cap member. The printer of JP-A-8-90782 includes a carriage (moving body) configured to be movable between the printing area and a side portion of the printing area (standby position). The carriage has a nozzle head (liquid ejecting head) on the lower side, and is supported to be freely slidable and rotatable about a guide shaft supported by a guide frame. The carriage is prevented from falling forward by including a guide roller to be in rolling contact with the lower face of the upper side portion of the guide frame.

Further, a convex portion is provided on the lower face of the upper side portion of the guide frame in the side portion of the printing area. Furthermore, a cap member that can perform capping of the nozzle head is placed in the side portion of the printing area. Furthermore, when the carriage is moved to the side portion of the printing area, due to the guide roller entering the concave portion of the upper side portion of the guide frame, the carriage rotates about the guide shaft due to its own weight and tilts forward. Capping is performed by the nozzle head being closely adhered to the cap member placed directly underneath due to the forward tilt of the carriage.

At this time, by a plate spring-like elastic member (engagement member) attached to a side end portion of the guide frame abutting the upper face of the carriage, the carriage is biased toward the cap member due to the elastic member, and the cap pressure is increased.

Incidentally, in the printer of JP-A-8-90782, in a case where flushing is performed within the cap member during printing, the carriage abuts the elastic member every time the carriage is moved to the side portion of the printing area to perform flushing. Therefore, there is a problem in which ink omission within the nozzles of the nozzle head occurs or the meniscus of the ink within the nozzles is destroyed.

SUMMARY

An advantage of some aspects of the invention is that there is provided a liquid ejecting apparatus that can reduce the impact when a moving body and an engagement member engage in a case where the engagement member that can engage with the moving body is placed on a movement path of the moving body supporting a liquid ejecting head.

According to an aspect of the invention, there is provided a liquid ejecting apparatus including: a moving body supporting a liquid ejecting head that can eject a liquid onto a target from nozzles and configured to be movable in a scanning direction; a position adjustment mechanism adjusting the position of the moving body to adjust the distance between the target and the liquid ejecting head; a cap member that can abut the liquid ejecting head to surround the nozzles; and an engagement member that can engage with the moving body further to a head opposing position side from a liquid ejecting area in a case where the moving body moves from the liquid ejecting area that is an area in which the liquid ejecting head can eject the liquid onto the target to the head opposing position that is a position opposing the cap member, wherein when the liquid ejecting head is at a position opposing the cap member, the position adjustment mechanism adjusts the position of the moving body so that the distance between the target and the liquid ejecting head changes between a first distance where the moving body does not engage with the engagement member when moving and a second distance, which is longer than the first distance, where the moving body engages with the engagement member when moving.

According to the aspect of the invention, in a case where the engagement member that can engage with the moving body is placed on the movement path of the moving body supporting the liquid ejecting head, the moving body engages with or does not engage with the engagement member by changing the distance between the target and the liquid ejecting head between the first distance and the second distance using the position adjustment mechanism. Furthermore, by making the speed at which the moving body is moved slower in a case where the moving body and the engagement member engage than for a case where the moving body and the engagement member do not engage, it is possible to reduce the impact when the moving body and the engagement member engage.

It is preferable that, in the liquid ejecting apparatus according to the aspect of the invention, in a case where the position adjustment mechanism adjusts the position of the moving body to the first distance, the moving body does not engage with the engagement member at a flushing position and engages with the engagement member at a capping position.

According to the aspect of the invention, in a case where the distance between the target and the liquid ejecting head is the first distance, since the moving body does not engage with the engagement member at the flushing position where the liquid ejecting head opposes the cap member, flushing can be performed smoothly at the flushing position. On the other hand, in a case where the distance between the target and the liquid ejecting head is the first distance, since the moving body engages with the engagement member at the capping position, it is possible to stabilize the posture at the capping position.

It is preferable that, in the liquid ejecting apparatus according to the aspect of the invention, the moving body is decelerated while moving from the liquid ejecting area to the head opposing position, and the timing at which the moving body is decelerated is earlier in a case where the distance between the target and the liquid ejecting head is the second distance than in the case of the first distance.

According to the aspect of the invention, in a case where the engagement member that can engage with the moving body is placed on the movement path of the moving body supporting the liquid ejecting head, since the timing at which the moving body is decelerated is earlier in a case where the moving body and the engagement member engage than in a case where the moving body and the engagement member do not engage, it is possible to reduce the impact when the moving body and the engagement member engage.

It is preferable that, in the liquid ejecting apparatus according to the aspect of the invention, the movement speed of the moving body is decelerated to 0, and the position at which the movement speed of the moving body becomes 0 is further to the liquid ejecting area side in the case of the second distance than for the case of the first distance.

According to the aspect of the invention, it is possible to reliably make the timing at which the moving body is decelerated earlier in a case where the moving body and the engagement member engage than in a case where the moving body and the engagement member do not engage.

It is preferable that, in the liquid ejecting apparatus according to the aspect of the invention, in a case where the moving body moves from the liquid ejecting area to the head opposing position, the movement speed at a position where the moving body opposes the engagement member is slower in a case where the distance between the target and the liquid ejecting head is the second distance than in the case of the first distance.

According to the aspect of the invention, since the movement speed of the moving body at a position opposing the engagement member is slower in a case where the moving body and the engagement member engage than in a case where the moving body and the engagement member do not engage, it is possible to reduce the impact when the moving body and the engagement member engage.

It is preferable that, in the liquid ejecting apparatus according to the aspect of the invention, in a case where the moving body is decelerated in a state in which the distance between the target and the liquid ejecting head is the second distance, the movement speed is decelerated from a first speed to 0 before being accelerated to a second speed which is slower than the first speed.

According to the aspect of the invention, it is possible to perform control when the moving body is decelerated easily.

It is preferable that, in the liquid ejecting apparatus according to the aspect of the invention, in a case where the distance between the target and the liquid ejecting head is the second distance, a portion of a deceleration area that is an area in which the movement speed of the moving body is decelerated from the first speed to 0 is included in the liquid ejecting area.

According to the aspect of the invention, since a portion of the deceleration area of the movement speed of the moving body is included in the liquid ejecting area, the space needed to secure the deceleration area can be reduced compared to a case where none of the deceleration area is included in the liquid ejecting area. Therefore, it is possible to contribute to the miniaturization of the apparatus.

It is preferable that, in the liquid ejecting apparatus according to the aspect of the invention, in a case where the distance between the target and the liquid ejecting head is the first distance, the moving body is moved from the liquid ejecting area to the head opposing position without being decelerated.

According to the aspect of the invention, it is possible to move the moving body from the liquid ejecting area to the head opposing position swiftly.

It is preferable that, in the liquid ejecting apparatus according to the aspect of the invention, the movement speed when the moving body moves from the flushing position to the capping position is faster in the case of the first distance than in the case of the second distance.

According to the aspect of the invention, it is possible to contribute to an improvement in the throughput of the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
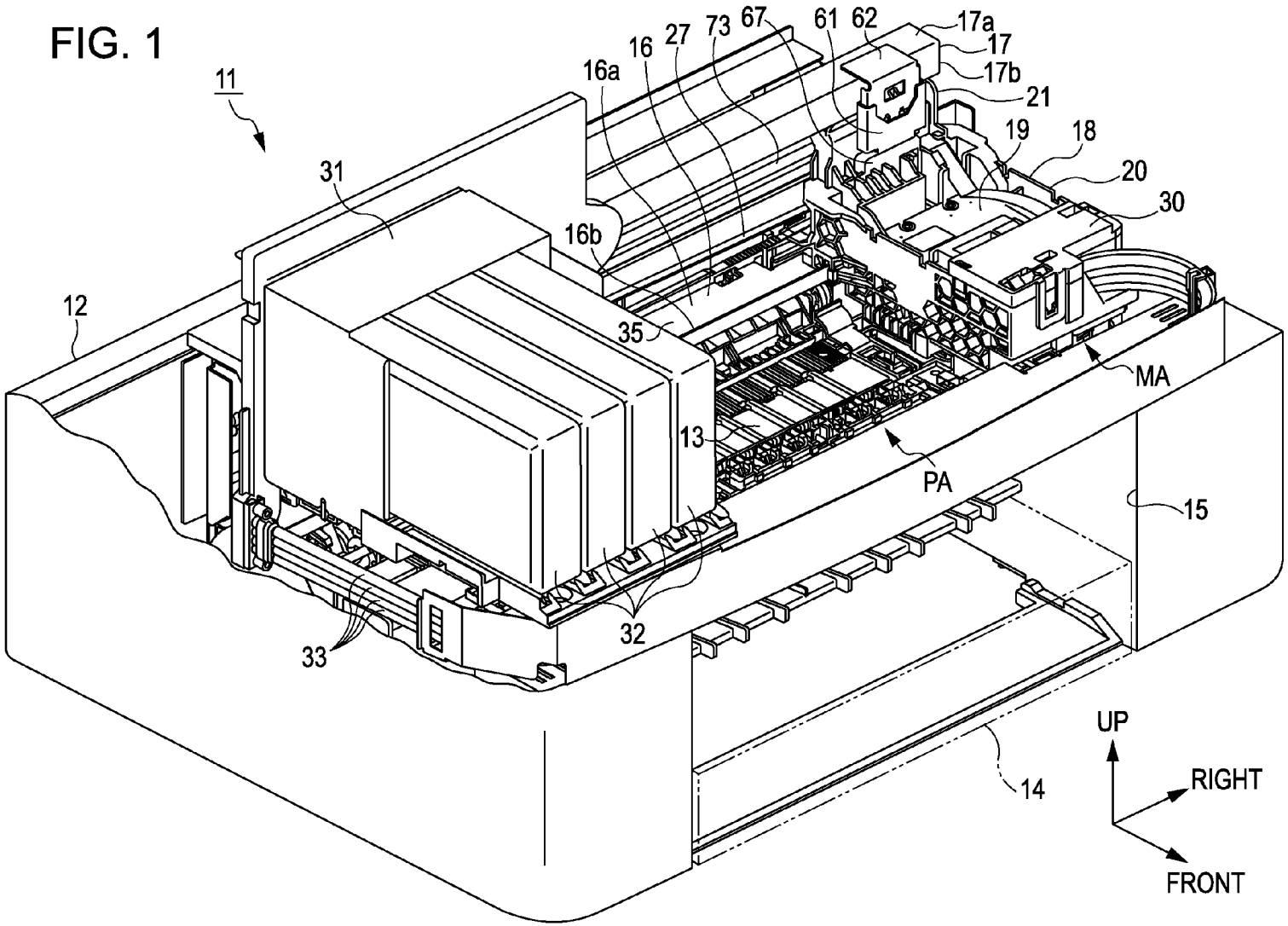
FIG. 1 is a schematic view of an ink jet printer of an embodiment.

An embodiment in which the liquid ejecting apparatus according to an aspect of the invention is realized as an ink jet printer will be described below in accordance with the drawings. Further, in the following description, "front and back direction", "left and right direction", and "up and down direction" respectively indicates the front and back direction, the left and right direction, and the up and down direction indicated in each drawing by arrows. Here, in the arrows indicating the up direction, the right direction, and the front direction in the drawings, arrows with "•" within a "○" (drawings in which the distal end of the arrow is seen from the front) indicate arrows pointing from the back of the paper to the front, and arrows with "x" within a "○" (drawings in which the back of the arrow is seen from the back) indicate arrows pointing from the front of the paper to the back.

Figure 2:
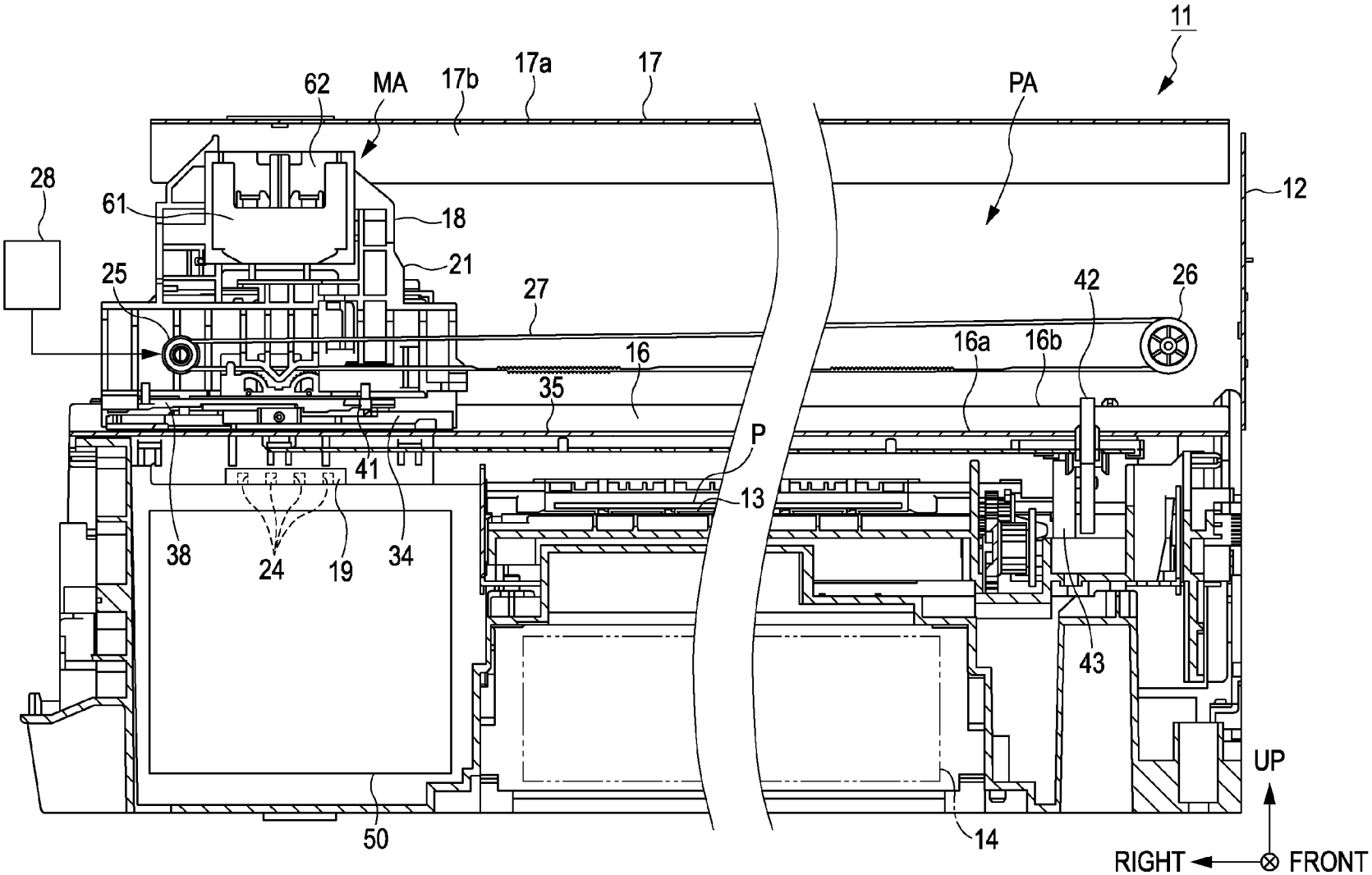
FIG. 2 is a schematic cross-sectional view illustrating the back of FIG. 1.

As illustrated in FIGS. 1 and 2, an ink jet printer 11 as a liquid ejecting apparatus includes a main body frame 12 with a substantially rectangular box shape. A support base 13 is provided in the main body frame 12 to extend along the left and right direction that is the scanning direction. A paper cassette 14 in which paper P as the target is stored in a laminated state is fitted below the support base 13 in the main body frame 12 to be freely detachable from an opening portion 15 provided in the front center portion of the main body frame 12. The paper P in the paper cassette 14 is supplied one sheet at a time by a paper feeding mechanism (not shown) from the back side to the support base 13 while being inverted.

A main guide member 16 extending in the left and right direction is provided across the top of the support base 13 in the main body frame 12. The main guide member 16 includes a belt-like main guide unit 16*a* extending to be parallel to the horizontal plane and an auxiliary guide unit 16*b* bending the front end rim portion of the main guide 16*a* upward at a right angle.

A sub guide member 17 with an L-shaped cross-section extending in the left and right direction is provided above the main guide member 16 of the main body frame 12. The sub guide member 17 includes a horizontal belt-like horizontal portion 17*a* and an auxiliary guide unit 17*b* bending the front side half of the horizontal portion 17*a* downward at a right angle. Furthermore, on the main guide member 16 and the sub guide member 17, a carriage 18 as a moving body is supported by cantilever at the back end portion side to be movable in the left and right direction.

Figure 3:
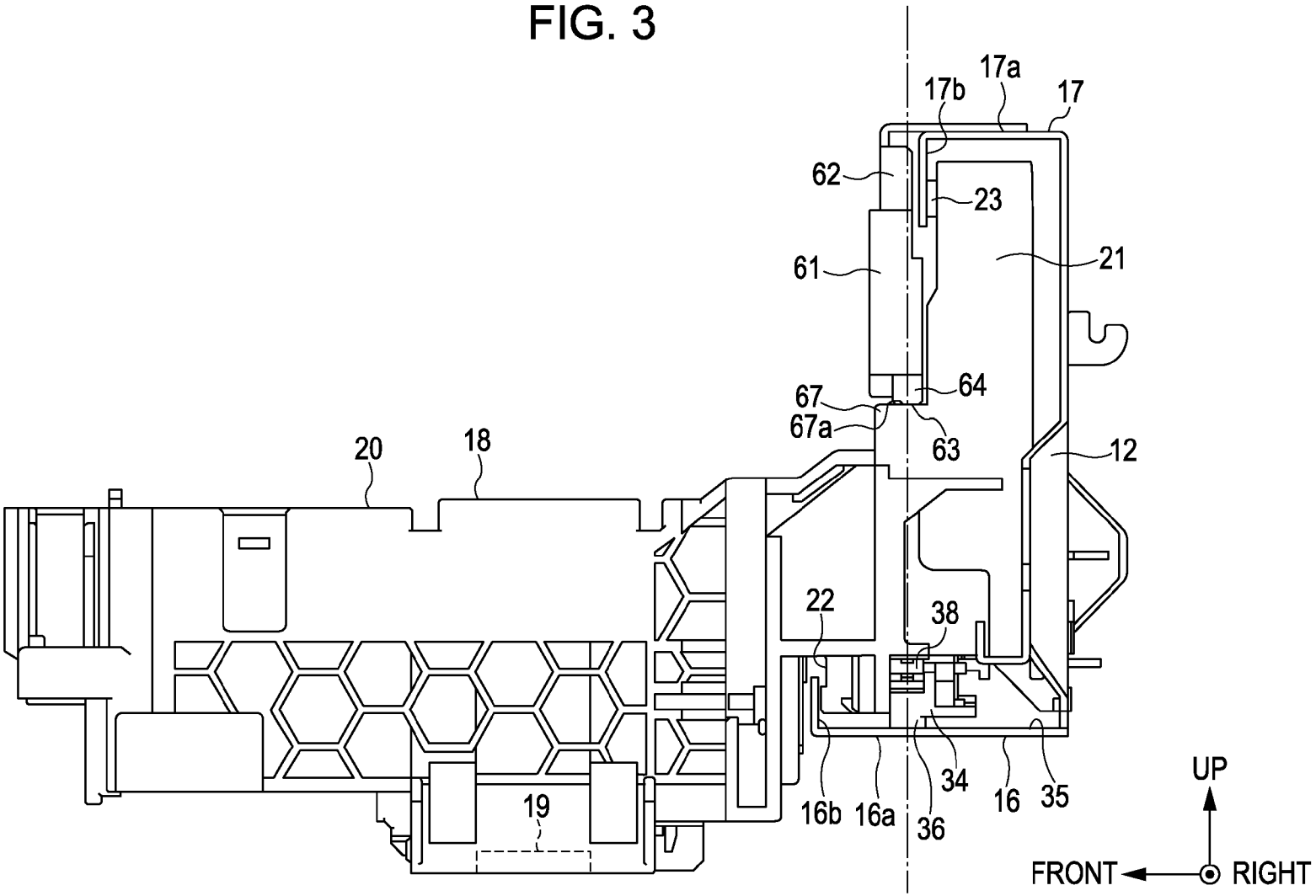
FIG. 3 is a side schematic view of a carriage of the printer.

As illustrated in FIGS. 1 to 3, the carriage 18 includes a support unit 20 with a substantially rectangular box shape supporting a recording head 19 as a liquid ejecting head that can eject ink a liquid from a plurality of nozzles 24 and a supported portion 21 formed integrally on the back side of the support unit 20 and supported by the main guide member 16 and the sub guide member 17. A concave groove 22 through which the auxiliary guide unit 16*b* penetrates is formed on the front end portion on the lower face of the supported portion 21. Therefore, the auxiliary guide unit 16*b* not only regulates the movement of the carriage 18 in the front and back direction but also permits movement of the carriage 18 in the left and right direction and the up and down direction.

Meanwhile, an auxiliary sliding contact unit 23 in sliding contact with the back face of the sub guide 17*b* due to the weight of the carriage 18 itself is formed on the front face on the upper end portion of the supported portion 21. Therefore, the auxiliary guide unit 17*b* not only regulates the movement of the carriage 18 to the front but also permits movement of the carriage 18 in the left and right direction and the up and down direction. Accordingly, the carriage 18 can move reciprocally in the left and right direction while being guided by the main guide member 16 and the sub guide member 17.

A portion of the carriage 18 is coupled with an endless timing belt 27 fitted between a driving pulley 25 and a driven pulley 26 respectively provided at both left and right end portions on the back wall inner face of the main body frame 12. The output axis of a carriage motor 28 provided on the main body frame 12 is coupled with the driving pulley 25. Therefore, the carriage 18 is moved reciprocally in the left and right direction along the main guide member 16 and the sub guide member 17 by the driving of the carriage motor 28.

As illustrated in FIGS. 1 and 2, the lower end portion of the recording head 19 is exposed on the lower face side of the carriage 18 opposing the support base 13. Meanwhile, a plurality of (four in the present embodiment) valve units 30 supplying temporarily retained ink to the recording head 19 are equipped on the carriage 18.

A plurality of nozzles 24 respectively configuring a plurality of (four in the present embodiment) nozzles rows are opened on the lower face of the recording head 19. Furthermore, printing is performed by the ink being respectively ejected from the opening of each nozzle 24 configuring each nozzle row onto the paper P supplied onto the support base 13. Here, an area in which recording on the paper P with the greatest width on the support base 13 by the recording head 19 is possible is a printing area PA as a liquid ejecting area.

A cartridge holder 31 is provided on the left end portion within the main body frame 12. A plurality of (four in the present embodiment) ink cartridges 32 containing inks of different colors from one another are fitted on the cartridge holder 31 to be respectively freely detachable. The cartridge holder 31 is respectively connected to each valve unit 30 on the carriage 18 via ink supply tubes 33.

Furthermore, in a state in which each ink cartridge 32 is fitted on the cartridge holder 31, each ink cartridge 32 is respectively in communication with each valve unit 30 via each ink supply tube 33.

Figure 4:
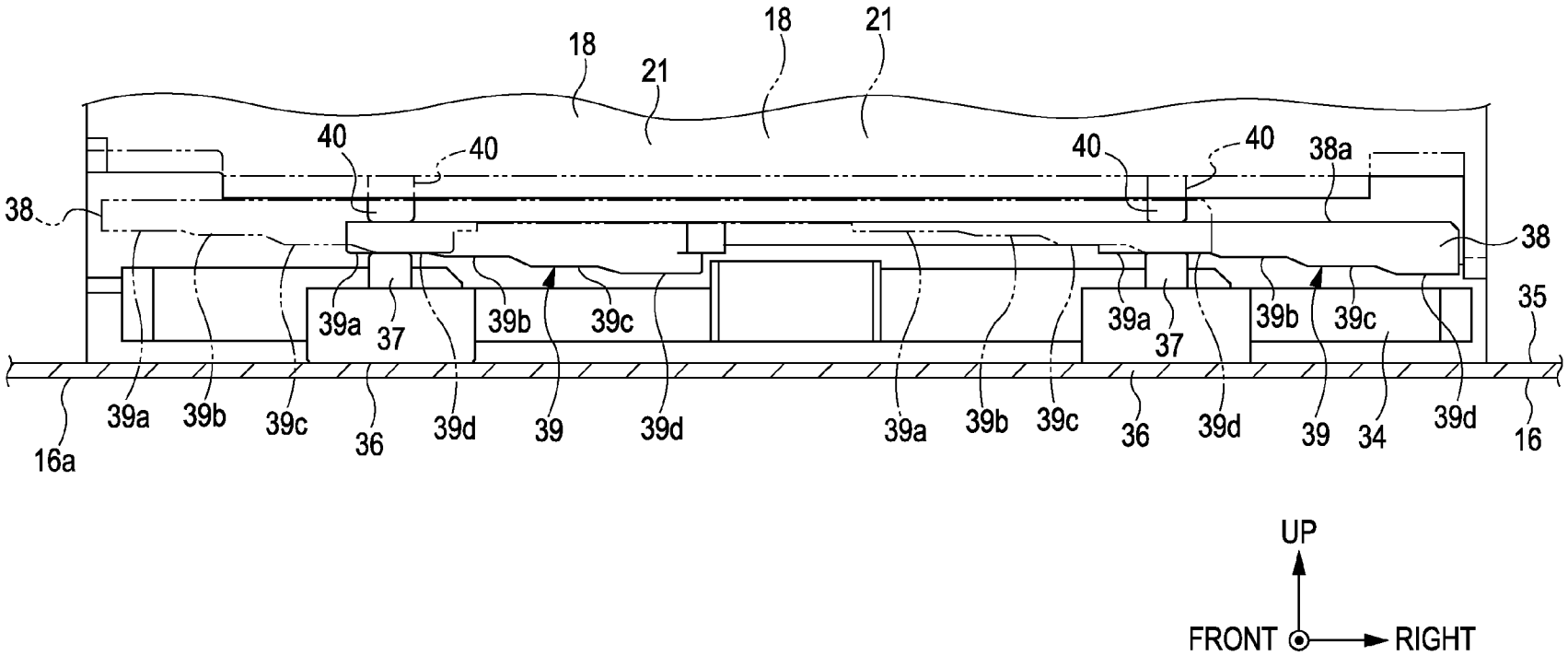
FIG. 4 is an expanded schematic view of the principal portions of the carriage.

As illustrated in FIGS. 2 to 4, the supported portion 21 of the carriage 18 is supported on the main guide unit 16*a* of the main guide member 16 to be slidable via a slide member 34 extending in the left and right direction to slide and move the carriage 18 smoothly. Therefore, the upper face of the main guide unit 16*a* is a sliding face 35. The slide member 34 includes a pair of left and right sliding contact portion 36 protruding downward and sliding with respect to the sliding face 35. That is, each sliding contact portion 36 is lined up with gaps therebetween along the left and right direction.

Convex portions 37 protruding upward are respectively provided on the upper face of each sliding contact portion 36. A cam member 38 as a position adjustment mechanism extending in the left and right direction is placed over each convex portion 37 to be across between each convex portion 37. While an upper face 38*a* of the cam member 38 is a horizontal face, a pair of left and right cam units 39 are formed on the lower face of the cam member 38. Each convex portion 37 is respectively in sliding contact with each cam unit 39.

Each cam unit 39 respectively includes four horizontal cam faces 39*a* to 39*d* lined up so that the height from the sliding face 35 gradually decreases from the left side toward the right side. Each of the cam faces 39*a* to 39*d* in order from the left side toward the right side is a first cam face 39*a*, a second cam face 39*b*, a third cam face 39*c*, and a fourth cam face 39*d*. The first cam face 39*a* and the second cam face 39*b*, the second cam face 39*b* and the third cam face 39*c*, and the third cam face 39*c* and the fourth cam face 39*d* are respectively connected via gentle inclined faces.

A pair of left and right leg portions 40 protruding on the lower face of the supported portion 21 of the carriage 18 respectively abut positions on the upper face 38*a* of the cam member 38 opposing each convex portion 37 with the cam member 38 therebetween. The cam member 38 can slide and move in the left and right direction with respect to each convex portion 37 and each leg portion 40. Furthermore, the cam member 38 can adjust the height position of the carriage 18 by changing the abutting position of each convex portion 37 with respect to each cam unit 39 by sliding and moving in the left and right direction.

An engagement pin 41 protruding toward the back is provided on the left end portion on the back face of the cam member 38. A cam move plate 42 that can engage with the engagement pin 41 in the left and right direction when the carriage 18 moves in the left and right direction is provided at a position on the back side of the main guide member 16 on the left end portion within the main body frame 12. The cam move plate 42 is configured to be rotated by a rotation mechanism 43 between an engagement position engaging with the engagement pin 41 and a non-engagement position not engaging with the engagement pin 41 when the carriage 18 moves in the left and right direction.

Furthermore, the cam member 38 slides and moves in the right direction by the movement force of the carriage 18 by moving the carriage 18 in the left direction in a state in which the cam move plate 42 is rotated at the engagement position and causing the engagement pin 41 to be engaged with the cam move plate 42 from the right side. On the other hand, the cam member 38 slides and moves in the left direction by the movement force of the carriage 18 by moving the carriage 18 in the right direction in a state in which the cam move plate 42 is rotated at the engagement position and causing the engagement pin 41 to be engaged with the cam move plate 42 from the left side.

Here, in a case where each convex portion 37 of the slide member 34 respectively abuts each first cam face 39*a* positioned at the highest position out of the cam faces 39*a* to 39*d* of the cam member 38 as illustrated by the solid line in FIG. 4, the position of the carriage 18 is in a state of being at the lowest position. From such a state, for example, if each convex portion 37 of the slide member 34 is in a state of respectively abutting each fourth cam face 39*d* positioned at the lowest position out of the cam faces 39*a* to 39*d* of the cam member 38 as illustrated by the double dotted chain line in FIG. 4 by moving the cam member 38 in the left direction, the position of the carriage 18 is in a state of being at the highest position.

That is, the height position of the carriage 18 is adjusted by moving in the up and down direction following the movement of the cam member 38 in the up and down direction along with the movement of the cam member 38 in the left and right direction. In such a case, since the recording head 19 is supported by the carriage 18, the distance between the recording head 19 and the support base 13, that is, the distance between the recording head 19 and the paper P on the support base 13, is adjusted by the adjustment of the height position of the carriage 18.

The distance between the recording head 19 and the paper P when each convex portion 37 of the slide member 34 respectively abuts each first cam face 39*a* of the cam member 38 and when each convex portion 37 of the slide member 34 respectively abuts each second cam face 39*b* of the cam member 38 is a first distance.

On the other hand, the distance between the recording head 19 and the paper P when each convex portion 37 of the slide member 34 respectively abuts each third cam face 39*c* of the cam member 38 and when each convex portion 37 of the slide member 34 respectively abuts each fourth cam face 39*d* of the cam member 38 is a second distance longer than the first distance. Here, the distance between the recording head 19 and the paper P is more frequently set to the first distance than to the second distance.

Figure 5:
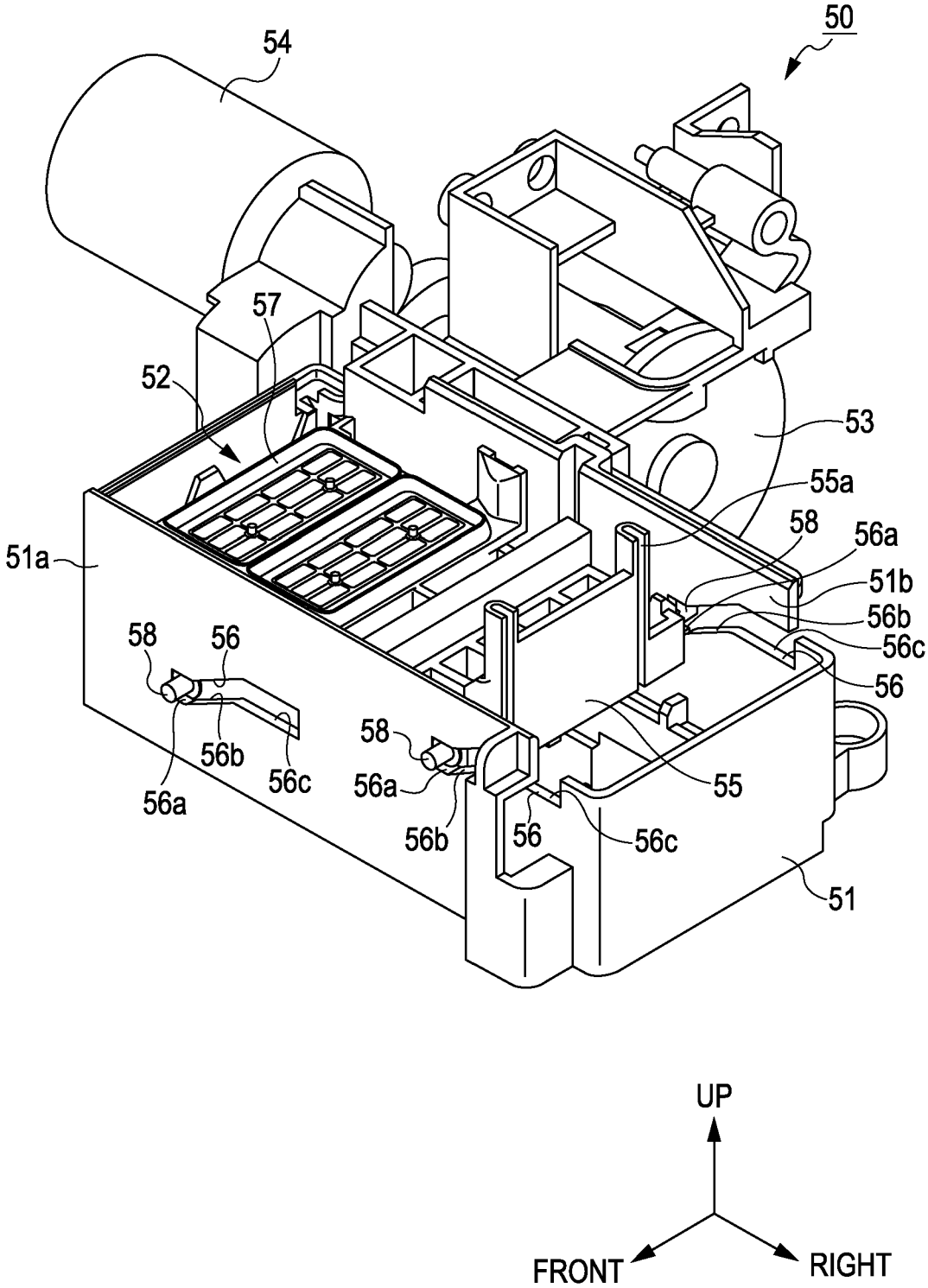
FIG. 5 is a schematic view of a maintenance unit of the printer.

As illustrated in FIGS. 2 and 5, a maintenance unit 50 for performing maintenance such as cleaning and flushing of the recording head 19 is placed in a maintenance area MA positioned at the right end portion within the main body frame 12.

The maintenance unit 50 includes a bottomed square box-shaped case 51 and a cap member 52 positioned approximately in the center portion of the case 51 which rises when moving toward the maintenance area MA of the carriage 18. The cap member 52 includes a bottomed square box-shaped cap 57 abutting the recording head 19 to surround each nozzle 24 in the maintenance area MA with a biasing force from the lower side of the perpendicular direction (up and down direction) orthogonal to the scanning direction (left and right direction) and a substantially box-shaped cap retaining member 55 retaining the cap 57 via an elastic member (not shown).

Further, the maintenance unit 50 includes a tube pump 53 for suctioning within the cap 57 via a flexible tube (not shown) and a pump motor 54 that is the driving source of the tube pump 53.

Two penetration grooves 56 are formed on a front wall 51*a* of the case 51 with a gap in the left and right direction. Of the two penetration grooves 56, that on the left side is placed at a lower position than that on the right side. Further, two penetration grooves 56 are also respectively formed on a back wall 51*b* of the case 51 at positions corresponding to the two penetration grooves 56 formed on the front wall 51*a*. Therefore, a total of four penetration grooves 56 are formed in the case 51.

Each penetration groove 56 includes a lower side flat portion 56*a* extending linearly and horizontally from left to right, an inclined face portion 56*b* extending straight from the right end of the lower side flat portion 56*a* diagonally upward to the right, and an upper side flat portion 56*c* extending linearly and horizontally from the right end of the inclined face portion 56*b* to the right. Furthermore, in each penetration groove 56, the lower side flat portion 56*a*, the inclined face portion 56*b*, and the upper side flat portion 56*c* are in communication with one another.

A total of four support bars 58 extending in the front and back direction to penetrate the respective penetration grooves 56 are provided on the cap retaining member 55 to correspond to the respective penetration grooves 56. Furthermore, the respective support bars 58 penetrating the penetration grooves 56 are slidable within the penetration grooves 56. Further, a substantially rectangular engagement plate 55*a* engaging with the right face of the carriage 18 when the carriage 18 moves from the printing area PA toward the maintenance area MA from the left toward the right direction is provided on the right end portion of the cap retaining member 55.

Further, the cap retaining member 55 is not only constantly biased toward the left side by a pulling coil spring 59 (refer to FIG. 6), but in a printing state in which the carriage 18 is not positioned in the maintenance area MA, each support bar 58 is respectively positioned on the lower side flat portion 56*a* furthest to the left side within each penetration groove 56 by the biasing force of the pulling coil spring 59. That is, in a case where the carriage 18 is positioned in the printing area PA, the cap retaining member 55 (cap member 52) is in a lowered state.

Furthermore, when the carriage 18 moves from the printing area PA to the maintenance area MA from the left toward the right direction, by the right face of the carriage 18 engaging with the engagement plate 55*a* of the cap retaining member 55, the cap retaining member 55 moves together with the carriage 18 to the right from the point of engagement.

That is, the cap retaining member 55 (cap member 52) rises by each support bar 58 respectively sliding from the left of each penetration groove 56 to the right, passing from the lower side flat portion 56*a* through the inclined face portion 56*b* and moving to the upper side flat portion 56*c* by abutting the right face of the carriage 18 and moving from left to right against the biasing force of the pulling coil spring 59. That is, the cap retaining member 55 (cap member 52) rises using the moving force of the carriage 18 by the carriage 18 pressing and moving the engagement plate 55*a* from left to right within the maintenance area MA.

At this time, the cap 57 gradually rises to approach the recording head 19 along with the rise of the cap retaining member 55. Furthermore, the cap 57 abuts the recording head 19 to surround each nozzle 24 at the stage when each support bar 58 reaches the upper side flat portion 56*c* of each penetration groove 56. That is, the recording head 19 is capped by the cap 57.

Here, since the biasing force that the carriage 18 receives from the pulling coil spring 59 increases as the carriage 18 moves to the right side since engaging with the engagement plate 55*a* of the cap retaining member 55, the load of the movement increases the further the carriage 18 moves to the right side.

Further, when the tube pump 53 is driven in a state in which the cap 57 abuts the recording head 19 to surround each nozzle 24 (state illustrated in FIG. 7), the space surrounded by the cap 57 and the recording head 19 is suctioned via a flexible tube (not shown), and a negative pressure is generated in the space. Through the negative pressure, so-called cleaning is performed in which the ink thickened in the recording head 19 is ejected along with bubbles and the like from each nozzle 24 into the cap 57 and into a waste liquid tank (not shown) via the flexible tube (not shown).

Further, the position of the carriage 18 when the recording head 19 opposes the cap 57 in the up and down direction in a state in which the cap member 52 is lowered (state in which each support bar 58 is respectively positioned at the lower side flat portion 56*a* within each penetration groove 56) is a head opposing position (flushing position). Furthermore, when periodically performing flushing during printing in which the ink is forcibly discharged from the recording head 19 into the cap 57, the carriage 18 is moved from the printing area PA to the head opposing position.

Figure 6:
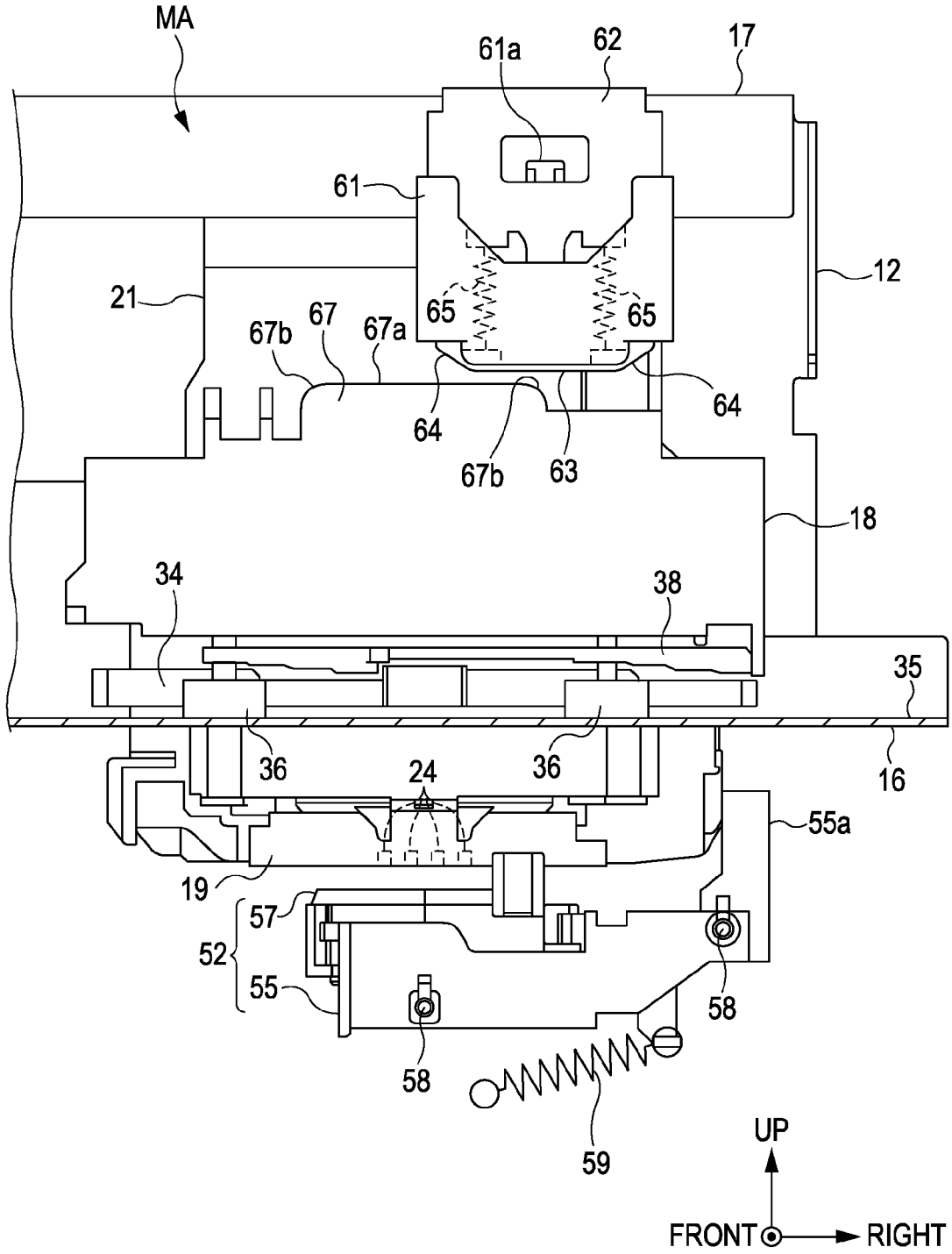
FIG. 6 is a front schematic view illustrating a state in which the carriage is at a head opposing position.

That is, the flushing during the printing is performed in a state in which the carriage 18 is moved to the head opposing position (state illustrated in FIG. 6). On the other hand, the position of the carriage 18 when the cap member 52 rises (when each support bar 58 is respectively positioned at the upper side flat portion 56*c* within each penetration groove 56), that is, the position of the carriage 18 when the recording head 19 is capped by the cap 57, is the capping position.

As illustrated in FIGS. 1 and 2, at the right end portion of the sub guide member 17, an engagement member 61 that can engage with the carriage 18 is attached via a substantially L plate-shaped attachment fitting 62 at a position opposing the cap member 52 interposing the carriage 18 that has moved to the maintenance area MA. That is, the attachment fitting 62 is not only fixed to the sub guide member 17 but the engagement member 61 is also attached to the attachment fitting 62 to be slidable and movable in the up and down direction.

In such a case, in a case where the carriage 18 is moved from the printing area PA to the head opposing position, the engagement member 61 is placed at a position that can engage with the carriage 18 between the printing area PA and the head opposing position. That is, the engagement member 61 is placed on the movement path of the carriage 18.

Figure 7:
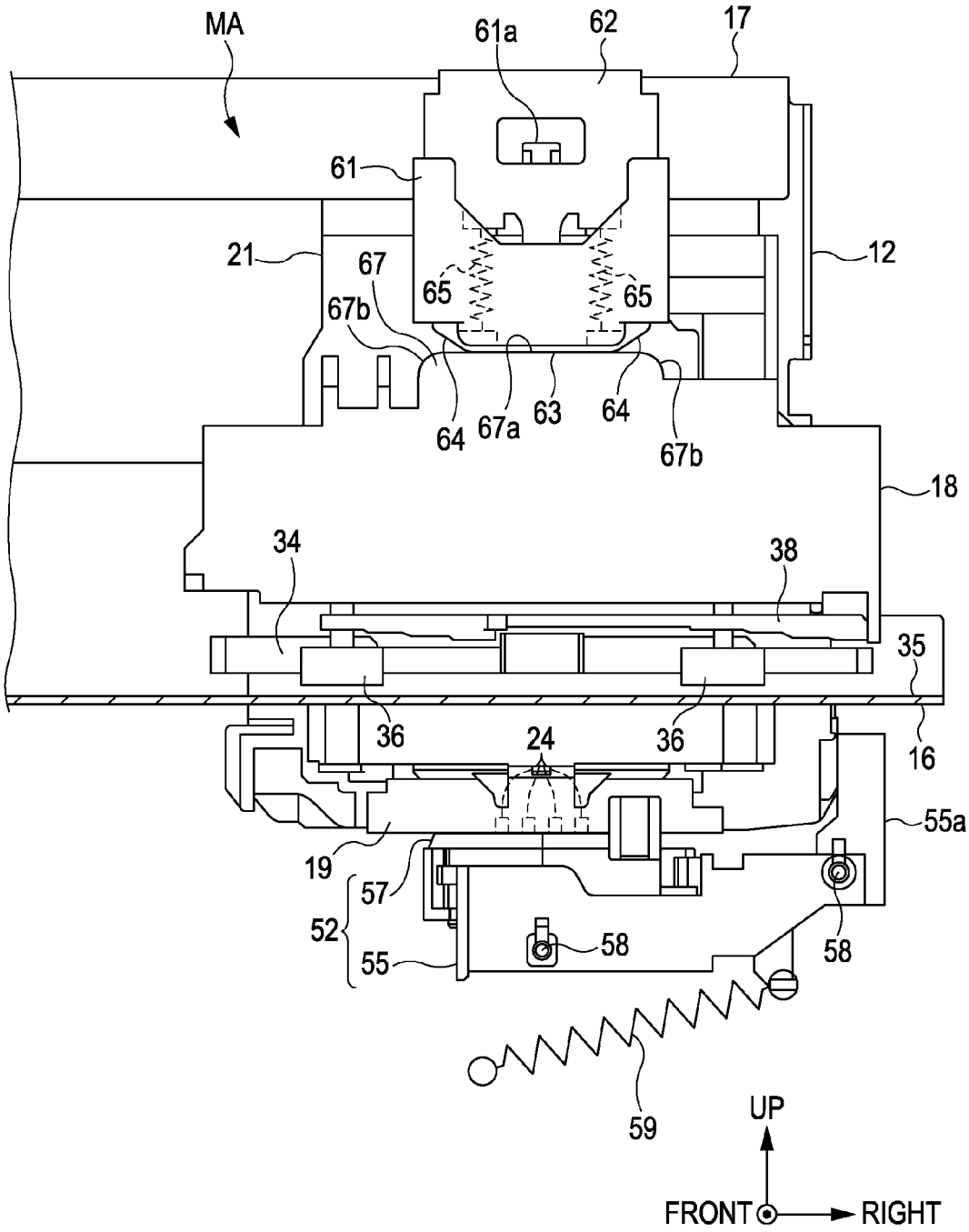
FIG. 7 is a front schematic view illustrating a state in which the carriage is at a capping position.

As illustrated in FIGS. 3 and 7, in a case where the carriage 18 is at the capping position, a block-shaped abutting portion 67 is provided at a position of the supported portion 21 of the carriage 18 abutting from the lower side of the perpendicular direction with respect to the engagement member 61. The width of the abutting portion 67 in the left and right direction is set to be approximately the same as the width of the engagement member 61 in the left and right direction. The upper face of the abutting portion 67 is an abutting face 67*a* with a rectangular shape that is long in the left and right direction which is parallel and flat with respect to the horizontal face. An arc face 67*b* that is adjacent to be continuous with the abutting face 67*a* is formed in the left and right corner portions of the upper end portion of the abutting portion 67.

A pressing face 63 that is parallel and flat with respect to the horizontal face is formed in the center portion of the lower end of the engagement member 61 in the left and right direction. A guide face 64 inclined to rise higher the further the guide face 64 is from the pressing face 63 in the left and right direction is formed on both left and right sides of the pressing face 63 at the lower end of the engagement member 61. Each guide face 64 is not only adjacent to be continuous with the pressing face 63 but is also inclined at an angle of approximately 30 degrees with respect to the horizontal face.

A pair of left and right compression coil springs 65 biased toward the lower side of the engagement member 61 in the perpendicular direction are fitted between the engagement member 61 and the attachment fitting 62. A locking portion 61*a* locked with respect to the attachment fitting 62 so that the engagement member 61 does not move to the lower side from a predetermined position due to the biasing force of the compression coil springs 65 is provided on the engagement member 61. Therefore, in a case where the carriage 18 is in the printing area PA, the engagement member 61 is always still at the predetermined position while receiving the biasing force of the compression coil springs 65.

Furthermore, in a case where the carriage 18 moves to the capping position and is pushed up by the cap member 52 and the abutting portion 67 abuts the engagement member 61, the engagement member 61 presses the abutting face 67*a* to the lower side that is the cap member 52 side using the pressing face 63 based on the biasing force of each compression coil spring 65.

That is, the engagement member 61 presses the abutting portion 67 toward the lower side based on the biasing force of each compression coil spring 65 in a state in which the pressing face 63 and the abutting face 67*a* are in face contact. In this regard, the engagement member 61 functions as a pressing member. In such a case, the engagement member 61 presses the abutting portion 67 toward the lower side at a position overlapping the sliding area of the slide member 34 on the sliding face 35 in the perpendicular direction.

Furthermore, in such a case, the action point of the pressing force on the abutting portion 67 by the engagement member 61 is at a position overlapping an area between the pair of left and right sliding contact portions 36 in the perpendicular direction. That is, the engagement member 61 transmits the biasing force of each compression coil spring 65 to the abutting portion 67 at a position overlapping the area between the pair of left and right sliding contact portions 36 in the perpendicular direction. Here, the width of the pressing face 63 in the left and right direction is narrower than the width of the abutting face 67*a* in the left and right direction.

Figure 8A:
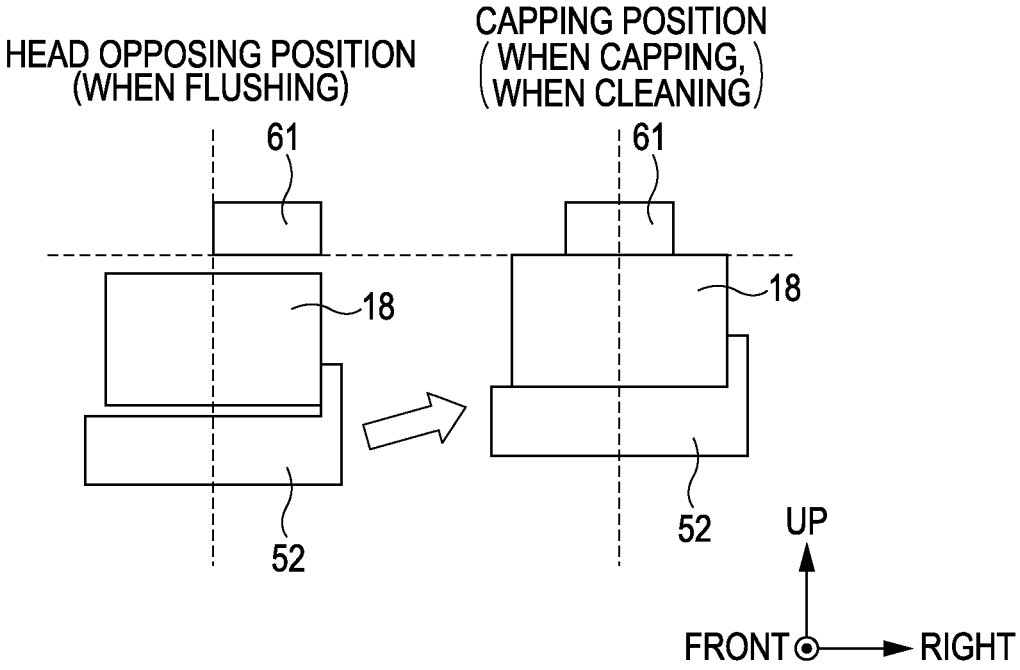
FIG. 8A is a schematic view illustrating the respective positional relationship of the carriage, an engagement member, and the cap member when the carriage is respectively at the head opposing position and the capping position in a case where the distance between the paper and the recording head is a first distance.

As illustrated in FIG. 8A, in a case where the distance between the recording head 19 and the paper P is the first distance, the carriage 18 does not engage with the engagement member 61 even if the carriage 18 is moved to the head opposing portion that is the position during flushing. Furthermore, in a case where the carriage 18 is moved from the head opposing position to the capping position that is the position during capping (during cleaning), the carriage 18 is lifted up by the cap member 52 and engaged with the engagement member 61. At this time, the carriage 18 is pressed down from the upper side by the engagement member 61 based on the biasing force of the compression coil springs 65 (refer to FIG. 7).

Figure 8B:
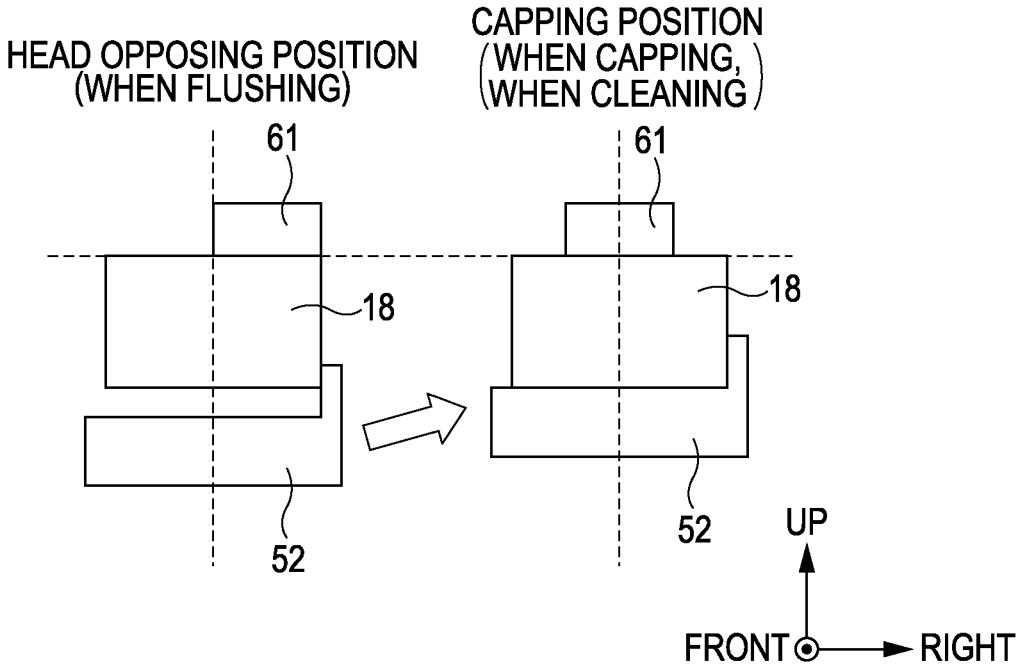
FIG. 8B is a schematic view illustrating the respective positional relationship of the carriage, the engagement member, and the cap member when the carriage is respectively at the head opposing position and the capping position in a case where the distance between the paper and the recording head is a second distance.

On the other hand, as illustrated in FIG. 8B, in a case where the distance between the recording head 19 and the paper P is the second distance, the carriage 18 engages with the engagement member 61 in a case where the carriage 18 is moved to the head opposing position that is the position during flushing. Furthermore, in a case where the carriage 18 is moved from the head opposing position to the capping position that is the position during capping (during cleaning), the carriage 18 is lifted up by the cap member 52 and engaged with the engagement member 61. At this time, the carriage 18 is pressed down from the upper side by the engagement member 61 based on the biasing force of the compression coil springs 65 (refer to FIG. 7).

Further, the upper limit position of the cap member 52 when the cap member 52 rises along with the movement of the carriage 18 to the capping position is always fixed regardless of whether the distance between the recording head 19 and the paper P is the first distance or the second distance. Therefore, the pressing force applied from the engagement member 61 when the carriage 18 is at the capping position is also always fixed.

Next, the size of the pressing force applied from the engagement member 61 (biasing force of the compression coil springs 65) when the carriage 18 is at the capping position will be described.

Figure 9:
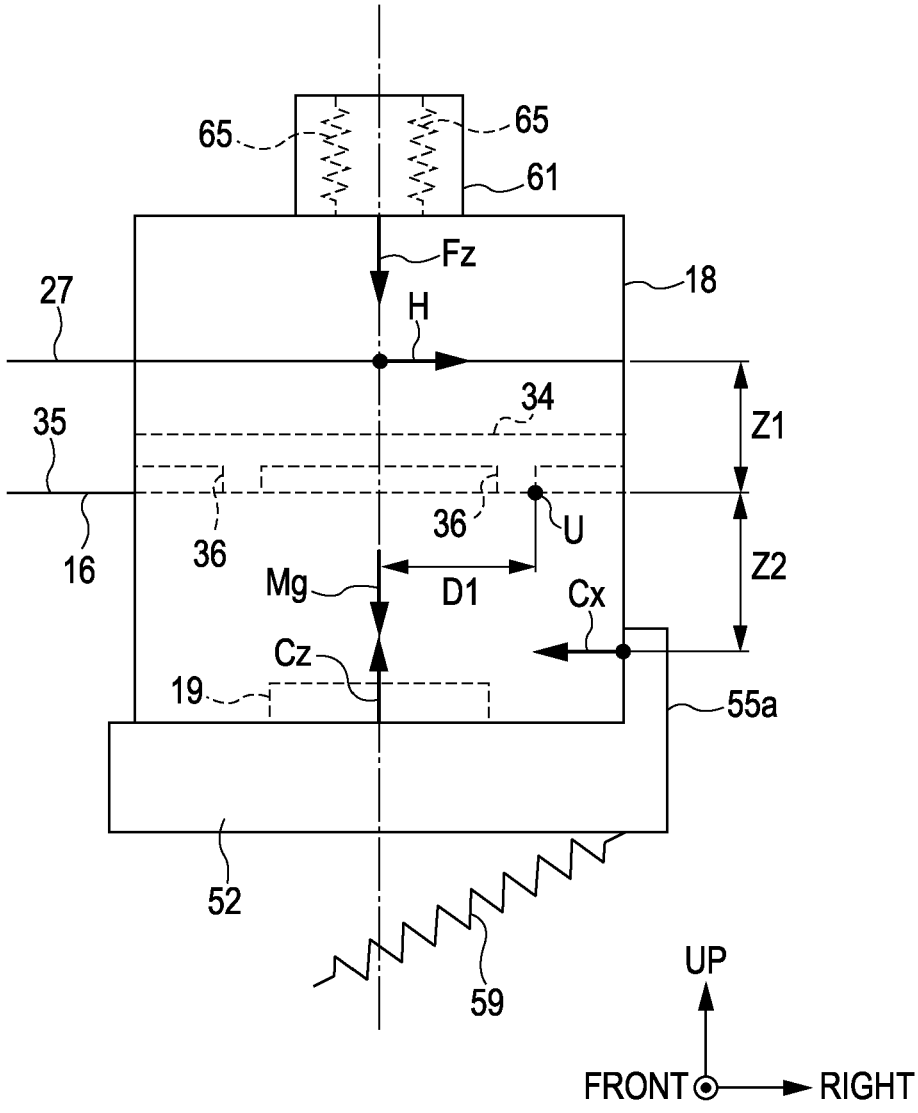
FIG. 9 is a front schematic view illustrating the force that acts on the carriage when the carriage moves to the capping position.

As illustrated in FIG. 9, when the carriage 18 moves to the capping position, a rotation force (rotation momentum) in a clockwise direction seen from the front side with the right end of the lower face of the sliding contact portion 36 on the right side out of the two sliding contact portions 36 of the slide member 34 as a center of rotation U acts on the carriage 18. That is, while a biasing force Cx of the pulling coil spring 59 acts on the carriage 18 toward the left via the engagement plate 55*a* further to the lower side from the center of rotation U, a transport force H by the timing belt 27 based on the driving force of the carriage motor 28 (refer to FIG. 2) further to the upper side from the center of rotation U acts toward the right on the carriage 18. Therefore, when the carriage 18 moves to the capping position, the carriage 18 has a posture (state) tilted to the right side.

In order to correct the posture of the carriage 18 tilted to the right side to be horizontal, it is necessary for the value of a pressing force Fz of the engagement member 61 pressing the carriage 18 at the capping position to satisfy the following Formula 1 and Formula 2. That is, it is necessary for the value of the pressing force Fz to satisfy Formula 1 from the balance of the force in the up and down direction and to satisfy Formula 2 from the balance of the rotation momentum.

$$Fz \leq Cz = Mg \quad \text{(Formula 1)}$$

$$Fz = Cz - Mg + H \times Z1/D1 + Cx \times Z2/D1 \quad \text{(Formula 2)}$$

In such a case, Cz is the biasing force acting on the carriage 18 toward the upper side in the perpendicular direction along with the abutting of the capping member 52 with the recording head 19 from the lower side in the perpendicular direction, and Mg is the weight of the carriage 18 itself. Further, H is the transport force by the timing belt 27, Cx is the biasing force of the pulling coil spring 59, D1 is the distance in the left and right direction from the center of rotation U to the Cz action point, the Mg action point, and the Fz action point. Furthermore, Z1 is the distance in the up and down direction from the center of rotation U to the H action point, and Z2 is the distance in the up and down direction from the center of rotation U to the Cx action point.

From Formula 1 described above, it can be said that the sum of the weight Mg of the carriage 18 itself and the pressing force Fz with which the engagement member 61 presses the carriage 18 at the capping position is equal to or greater than the biasing force Cz acting on the carriage 18 toward the upper side of the perpendicular direction along with the abutting of the cap member 52 with the recording head 19 from the lower side of the perpendicular direction.

Furthermore, if the pressing force Fz is a value satisfying Formula 1 and Formula 2 described above, in a case where capping of the recording head 19 is performed by the cap member 52, the cap member 52 is sufficiently closely adhered to the recording head 19 by the pressing force Fz acting on the carriage 18. In such a case, since the posture of the carriage 18 is also corrected to be horizontal by the pressing force Fz, capping failure of the recording head 19 by the cap member 52 is also suppressed.

Here, considering the load on the carriage motor 28 (refer to FIG. 2), it is preferable that the pressing force Fz be set to as small a value as possible while satisfying Formula 1 and Formula 2 described above.

Next, the electrical configuration of an ink jet printer 11 will be described.

Figure 10:
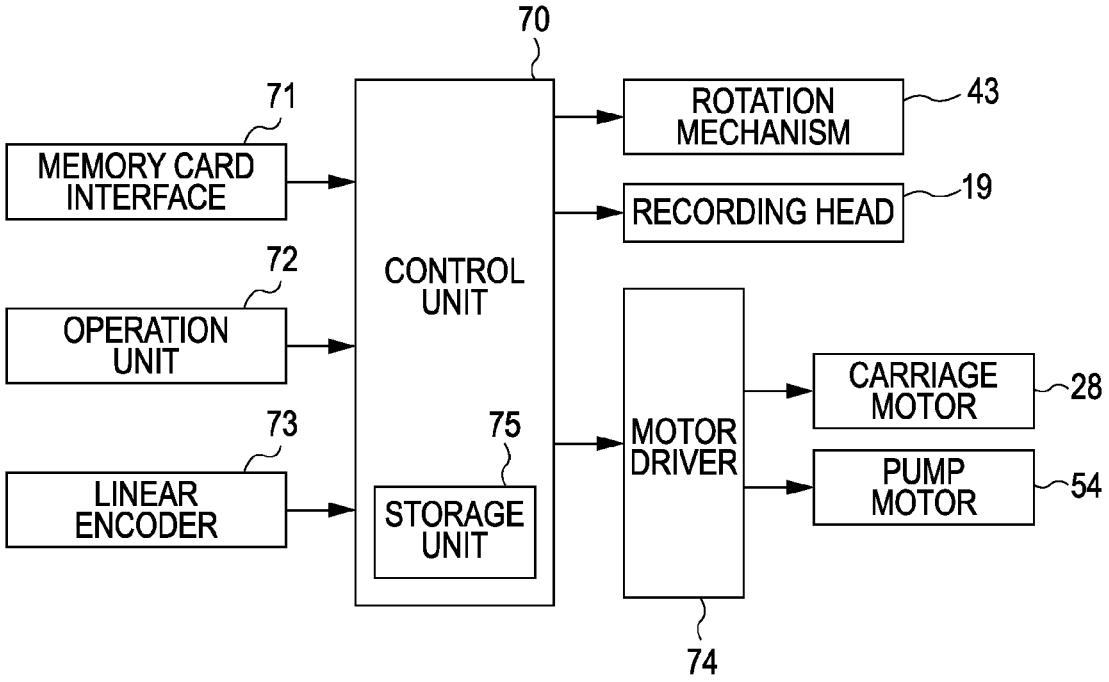
FIG. 10 is a block diagram illustrating the electrical configuration of the printer.

As illustrated in FIG. 10, the ink jet printer 11 includes a control unit 70 controlling the overall operation state of the ink jet printer 11, a memory card interface 71 to which a memory card (not shown) with image data stored is connected, and an operation unit 72 that can operate various inputs such as the type of the paper P, the resolution of an image to be printed on the paper P, and the number of printed sheets. The operation unit 72 has a display screen for the user to verify input items when performing various input operations.

The control unit 70 is respectively electrically connected to the memory card interface 71, the operation unit 72, a linear encoder 73 detecting the movement amount of the carriage 18, the recording head 19, and a rotation mechanism 43. Further, the control unit 70 is respectively electrically connected to the carriage motor 28 and the pump motor 54 via a motor driver 74.

Furthermore, the control unit 70 respectively controls the driving of the recording head 19 and the rotation mechanism 43 based on signals respectively transmitted from the operation unit 72 and the linear encoder 73, and respectively controls the driving of each motor 28 and 54 via the motor driver 74. Further, the control unit 70 ascertains the position of the carriage 18 by computing the movement amount of the carriage 18 by counting pulse signals from the linear encoder 73 transmitted as the carriage 18 moves.

Further, the control unit 70 includes a storage unit 75 configured by a ROM, a RAM, a non-volatile memory, or the like. Various pieces of information such as the number of printed sheets input from the operation unit 72, image data read from the memory card (not shown), various control programs, and the like are respectively stored in the storage unit 75.

Next, the action of the ink jet printer 11 will be described.

Case Where Distance Between Paper P and Recording Head 19 is First Distance

Figure 11:
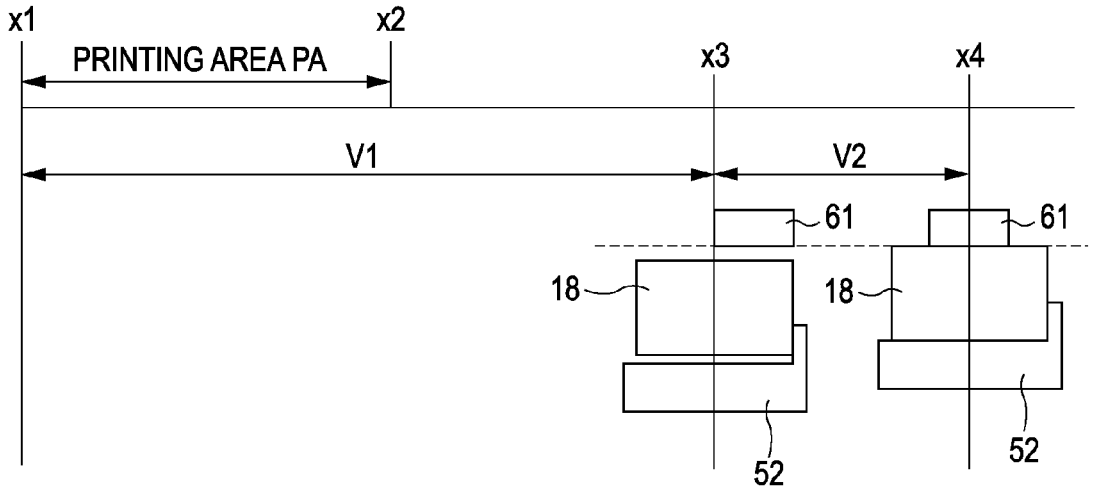
FIG. 11 is a schematic view describing the relationship between the speed and the position of the carriage in a case where the distance between the paper and the recording head is the first distance.
Figure 12:
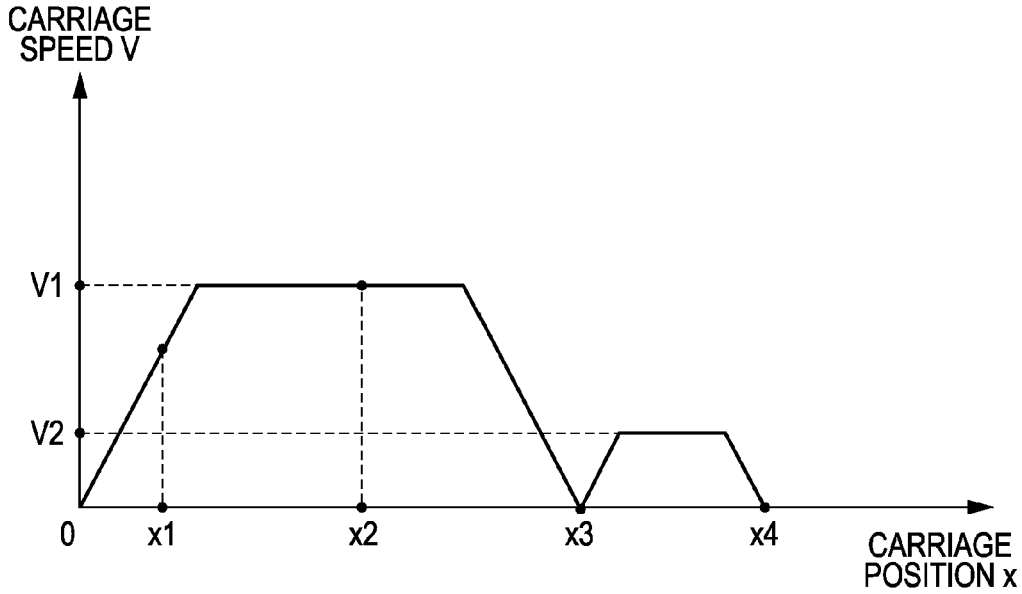
FIG. 12 is a graph illustrating the relationship between the speed and the position of the carriage in a case where the distance between the paper and the recording head is the first distance.

As illustrated in FIGS. 11 and 12, in a case where printing is performed when the distance between the paper P and the recording head 19 is the first distance, printing on the paper P is performed by ink being ejected from each nozzle 24 of the recording head 19 respectively onto the paper P while the carriage 18 moves reciprocally between left and right at a first speed V1 that is the maximum speed in the printing area PA (area from a position x1 to a position x2). Furthermore, the carriage 18 periodically moves to a head opposing position x3 in order to perform flushing during printing.

At this time, since the carriage 18 is not engaged (collided) with the engagement member 61 at the head opposing position x3, the carriage 18 moves to the head opposing position x3 while maintaining the first speed V1 and stops (the movement speed V is 0). That is, until the carriage 18 moves from at least the printing area PA to the head opposing position x3 side, the carriage 18 does not decelerate and the movement speed V of the carriage 18 is maintained to be the first speed V1. In such a case, deceleration begins before the head opposing position x3 so that the carriage 18 can stop at the head opposing position x3.

In such a manner, since the carriage 18 is moved to the head opposing position x3 for performing flushing at the first speed V1 that is the same as during printing, a decrease in the printing throughput due to the periodic flushing during the printing is suppressed.

Further, in a case where cleaning is performed, the carriage 18 is moved from the head opposing position x3 to a capping position x4. At this time, there is a load on the carriage 18 due to the cap member 52 in the movement of the carriage 18 from the head opposing position x3 to the capping position x4. Therefore, the carriage 18 is moved from the head opposing position x3 to the capping position x4 at a second speed V2 (speed that is approximately one eighth of the first speed V1 in the present embodiment) that is slower than the first speed V1.

As a result, while the biasing force Cx of the pulling coil spring 59 acts on the carriage 18 further to the lower side from the center of rotation U via the engagement plate 55*a* toward the left, the transport force H by the timing belt 27 based on the driving force of the carriage motor 28 acts on the carriage 18 further to the upper side from the center of rotation U toward the right. Therefore, the carriage 18 tends to adopt a posture tilted to the right side.

However, since the capping of the recording head 19 is performed by the cap member 52 at this time, the carriage 18 is pushed up from the lower side by the cap member 52 and pressed by the engagement member 61 from the upper side toward the lower side. Therefore, the posture of the carriage 18 is corrected to a horizontal state.

In so doing, since the cap member 52 abuts the recording head 19 linearly and the recording head 19 is pressed against the cap member 52 via the carriage 18 by the engagement member 61, the cap member 52 and the recording head 19 are sufficiently closely adhered. In such a case, capping failure of the recording head 19 by the cap member 52 due to the tilt of the carriage 18 is also suppressed. Cleaning of the recording head 19 is then performed by driving the tube pump 53.

Here, even in a case where the carriage 18 is moved from the printing area PA to the capping position x4, since there is a load on the carriage 18 between the head opposing position x3 and the capping position x4 due to the cap member 52, the carriage 18 is moved to the capping position x4 at the second speed V2 after momentarily being stopped at the head opposing position x3.

Case Where Distance Between Paper P and Recording Head 19 is Second Distance

Figure 13:
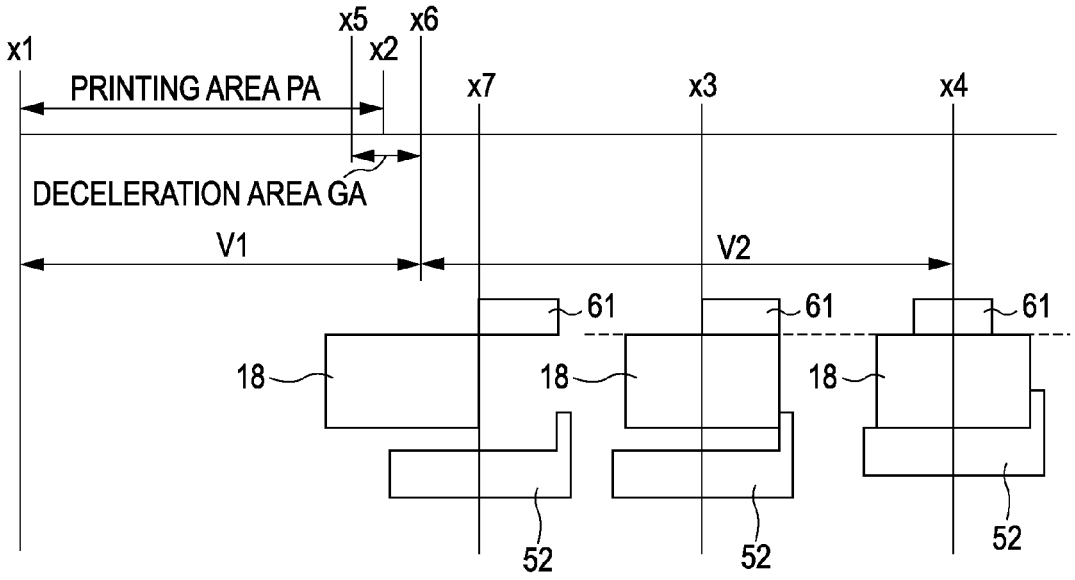
FIG. 13 is a schematic view describing the relationship between the speed and the position of the carriage in a case where the distance between the paper and the recording head is the second distance.
Figure 14:
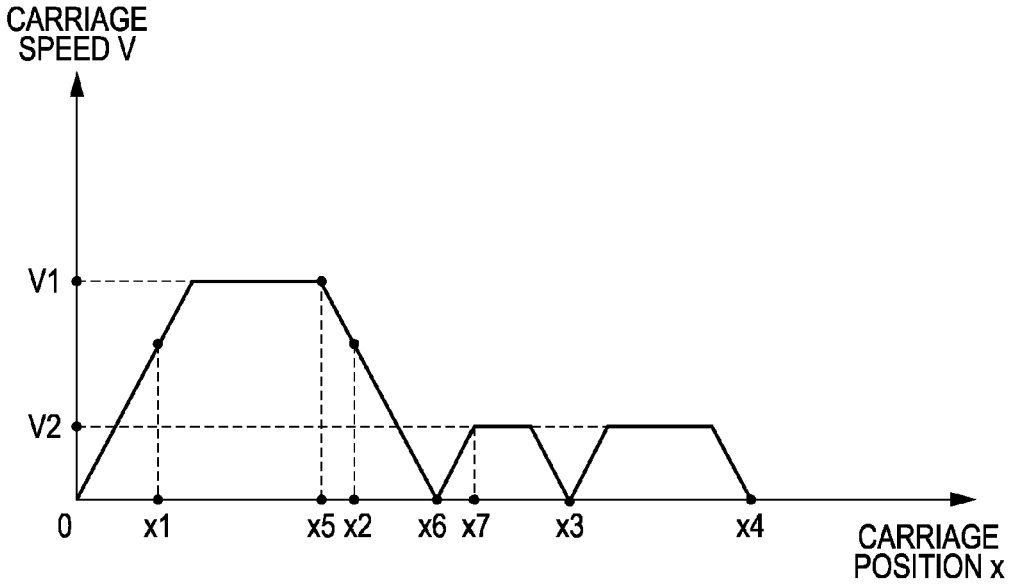
FIG. 14 is a graph illustrating the relationship between the speed and the position of the carriage in a case where the distance between the paper and the recording head is the second distance.

As illustrated in FIGS. 13 and 14, in a case where printing is performed when the distance between the paper P and the recording head 19 is the second distance, printing on the paper is performed by each nozzle 24 of the recording head 19 respectively ejecting ink onto the paper P while the carriage 18 moves reciprocally left and right at the first speed V1 that is the maximum speed in the printing area PA (area from the position x1 to the position x2). Furthermore, the carriage 18 periodically moves to the head opposing position x3 to perform flushing during printing.

At this time, since the carriage 18 is engaged (collided) with the engagement member 61 at a position x7 before reaching the head opposing position x3, the carriage 18 moves to the head opposing position x3 at the second speed V2 by decelerating from the first speed V1 to the second speed V2 before engaging with the engagement member (between a position x5 and the position x7). That is, the carriage 18 moves to the head opposing position x3 at the second speed V2 by decelerating from the first speed V1 to 0 (stopped state) immediately before engaging with the engagement member 61 (position x6) and accelerating from 0 to the second speed V2.

In such a case, a portion (area from the position x5 to the position x2) of a deceleration area GA (area from the position x5 to the position x6) that is the area in which the movement speed V of the carriage 18 decelerates from the first speed V1 to 0 is included in the printing area PA (area from the position x1 to the position x2). Furthermore, in such a case, deceleration begins before the head opposing position x3 so that the carriage 18 can stop at the head opposing position x3.

Therefore, in a case where the carriage 18 moves from the printing area PA to the head opposing position x3, the timing at which the carriage 18 is decelerated is earlier than a case where the distance between the paper P and the recording head 19 described above is the first distance.

In such a case, the movement speed V of the carriage 18 at the position x7 where the abutting portion 67 of the carriage 18 and the engagement member 61 engage (oppose above and below in a state of contact) is slower than the movement speed V at a position that equates to the position x7 where the abutting portion 67 of the carriage 18 and at least a portion of the engagement member 61 are opposing above and below in a case where the distance between the paper P and the recording head 19 described above is the first distance.

In such a manner, since the carriage 18 is moved to the head opposing position x3 for performing flushing at the second speed V2 that is slower than the first speed V1 during the printing, the impact when the carriage 18 and the engagement member 61 engage (collide) is decreased compared to a case where the carriage 18 is moved to the head opposing position x3 at the first speed V1. Therefore, since the ink within each nozzle 24 escaping due to the impact of the engagement (collision) between the carriage 18 and the engagement member 61 is suppressed, the occurrence of ink ejection failure such as dot omission is decreased.

Incidentally, if the carriage 18 is moved to the head opposing position x3 while still at the first speed V1 in order to perform periodic flushing, the ink within each nozzle 24 escapes due to the impact of the engagement (collision) between the carriage 18 and the engagement member 61, inviting ink ejection failure such as dot omission.

Further, in a case where cleaning is to be performed, the carriage 18 is moved from the head opposing position x3 to the capping position x4. At this time, in the movement of the carriage 18 from the head opposing position x3 to the capping position x4, there is a load on the carriage 18 due to the cap member 52 in addition to a load due to the engagement member 61. Therefore, the carriage 18 is moved from the head opposing position x3 to the capping position x4 while still at the second speed V2.

Then, as described above, while the biasing force Cx of the pulling coil spring 59 acts on the carriage 18 via the engagement plate 55*a* toward the left further to the lower side of the center of rotation U, the transport force H by the timing belt 27 based on the driving force of the carriage motor 28 acts on the carriage 18 toward the right further to the upper side from the center of rotation U. Therefore, the carriage 18 tends to adopt a posture tilted to the right side.

However, since the capping of the recording head 19 is performed by the cap member 52 at this time, the carriage 18 is pushed up from the lower side by the cap member 52 and pressed by the engagement member 61 from the upper side toward the lower side. Therefore, the posture of the carriage 18 is corrected to a horizontal state.

In so doing, since the cap member 52 abuts the recording head 19 linearly and the recording head 19 is pressed against the cap member 52 via the carriage 18 by the engagement member 61, the cap member 52 and the recording head 19 are sufficiently closely adhered. In such a case, capping failure of the recording head 19 by the cap member 52 due to the tilt of the carriage 18 is also suppressed. Cleaning of the recording head 19 is then performed by driving the tube pump 53.

Here, in a case where the carriage 18 is moved from the printing area PA to the capping position x4, since there is a load on the carriage 18 between the position x6 and the capping position x4 due to at least one of the engagement member 61 and the cap member 52, the carriage 18 is moved from the position x6 to the capping position x4 at the second speed V2.

Here, the action when the abutting portion 67 of the carriage 18 and the engagement member 61 engage along with the movement of the carriage 18 to the capping position x4 will be described.

Figure 15A:
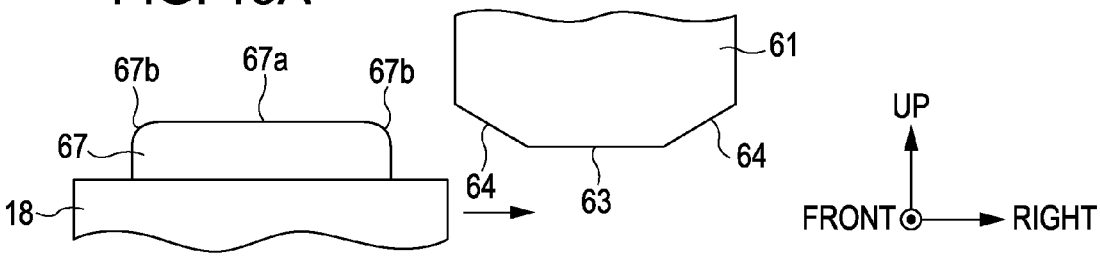
FIGS. 15A to 15D are schematic views describing the operation when the carriage and the engagement member are engaged in a case where the distance between the paper and the recording head is the second distance.
Figure 15B:
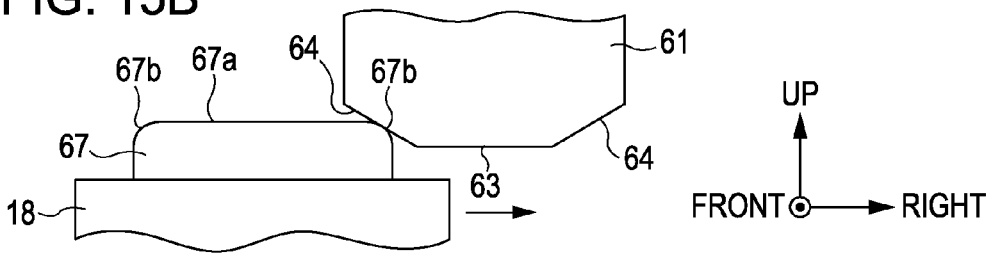

Now, in a case where the distance between the paper P and the recording head 19 is the second distance, as illustrated in FIG. 15A, the arc face 67*b* of the abutting portion 67 of the carriage 18 and the guide face 64 of the engagement member 61 are opposing in the left and right direction. Furthermore, when the carriage 18 is moved to the right direction, as illustrated in FIG. 15B, the arc face 67*b* of the abutting portion 67 abuts the guide face 64 of the engagement member 61. If the carriage 18 is continued to be moved to the right direction, the arc face 67*b* of the abutting portion 67 slides the guide face 64 of the engagement member 61 toward the pressing face 63, and the engagement member 61 rises against the biasing force of the compression coil spring 65 (refer to FIG. 7) due to the sliding.

Figure 15C:
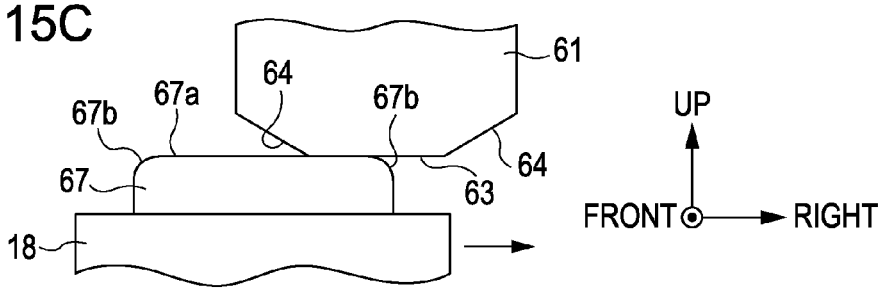

Furthermore, when the carriage 18 reaches the head opposing position x3, as illustrated in FIG. 15C, the right end portion of the abutting face 67*a* of the abutting portion 67 and the left end portion of the pressing face 63 of the engagement member 61 are in a state of face contact. That is, the abutting portion 67 of the carriage 18 is led to the pressing face 63 of the engagement member 61 by the guide face 64 of the engagement member 61. At this time, the pressing face 63 of the engagement member 61 presses the abutting face 67*a* of the abutting portion 67 downward based on the biasing force of the compression coil spring 65 (refer to FIG. 7).

Figure 15D:
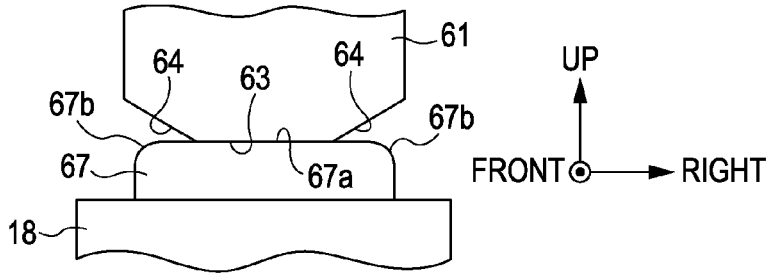

Furthermore, when the carriage 18 reaches the capping position x4, as illustrated in FIG. 15D, the entire pressing face 63 of the engagement member 61 is in a state of face contact with the abutting face 67*a* of the abutting portion 67. Through the face contact, the carriage 18 is pressed downward stably by the engagement member 61.

The following effects can be obtained through the embodiments described in detail above.

(1) In a case where the carriage 18 is moved to the capping position, the sum of the weight Mg of the carriage 18 itself and the pressing force Fz with which the engagement member 61 presses the carriage 18 to the lower side in the perpendicular direction is set to be equal to or greater than the biasing force Cz acting on the carriage 18 toward the upper side in the perpendicular direction along with the abutting of the cap member 52 with the recording head 19 from the lower side in the perpendicular direction. Therefore, when capping of the recording head 19 is performed at the capping position by the cap member 52, the carriage 18 is pressed down by the engagement member 61 from the upper side toward the lower side with a sufficient pressing force Fz against the biasing force Cz with which the carriage 18 is pressed up from the lower side by the cap member 52. In so doing, since the recording head 19 and the cap member 52 press against each other, the close adhesion force between the recording head 19 and the cap member 52 can be increased. Therefore, even if the height position of the carriage 18 supporting the recording head 19 is adjustable, the cap member 52 can be sufficiently closely adhered to the recording head 19.

Incidentally, in a case where the sum of the weight Mg of the carriage 18 itself and the pressing force Fz of the engagement member 61 is less than the biasing force Cz of the cap member 52, when capping of the recording head 19 is performed by the cap member 52, the carriage 18 is only pressed up from the lower side by the biasing force Cz of the cap member 52. That is, the carriage 18 is unilaterally pressed up by the cap member 52. Therefore, since the force with which to press down the cap member 52 onto the recording head 19 is missing, the cap member 52 cannot be sufficiently closely adhered to the recording head 19.

(2) Since the engagement member 61 presses the carriage 18 at a position overlapping the sliding area of the sliding member 34 on the sliding face 35 in the perpendicular direction, a pressing force can be effectively applied on the carriage 18 by the engagement member 61.

(3) Since the action point of the pressing force by the engagement member 61 on the abutting portion 67 of the carriage 18 is at a position overlapping an area between the pair of left and right sliding contact portions 36 in the perpendicular direction, the pressing force applied by the engagement member 61 on the abutting portion 67 of the carriage 18 can be received evenly by each sliding contact portion 36 of the slide member 34. Therefore, the carriage 18 can be stably supported by the slide member 34.

(4) Since the engagement member 61 presses the abutting portion 67 in a state in which the pressing face 63 that is horizontal and flat with respect to the abutting portion 67 of the carriage 18 is in face contact, the carriage 18 can be stably pressed by the engagement member 61.

(5) Since the engagement member 61 includes the guide face 64 leading the abutting portion 67 to the pressing face 63 when engaged with the abutting portion 67 of the carriage 18 in the left and right direction (scanning direction), the abutting portion 67 can be led to the pressing face 63 smoothly by the guide face 64. In such a case, since the guide face 64 of the engagement member 61 is inclined, the impact when the abutting portion 67 of the carriage 18 engages (collides with) the guide face 64 can be lessened.

(6) In a case where the carriage 18 moves from the printing area PA to the head opposing position x3, the timing at which the carriage 18 is decelerated is earlier in a case where the distance between the paper P and the recording head 19 is the second distance than the case of the first distance. Therefore, since the timing at which the carriage 18 is decelerated is earlier in a case where the carriage 18 and the engagement member 61 are engaged than in a case where the carriage 18 and the engagement member 61 are not engaged, the impact when the carriage 18 and the engagement member 61 engage can be reduced.

(7) In a case where the carriage 18 moves from the printing area PA to the head opposing position x3, since the movement speed of the carriage 18 at a position opposing the engagement member 61 is slower when the distance between the paper P and the recording head 19 is the second distance than in the case of the first distance, the impact when the carriage 18 and the engagement member 61 engage can be reduced.

(8) In a case where the carriage 18 is decelerated in a state in which the distance between the paper P and the recording head 19 is the second distance, since the movement speed is decelerated from the first speed V1 to 0 before being accelerated to the second speed V2 that is slower than the first speed V1, the control when decelerating the carriage 18 can be performed easily by the control unit 70.

(9) In a case where the distance between the paper P and the recording head 19 is the second distance, a portion of the deceleration area GA that is the area in which the movement speed of the carriage 18 is decelerated from the first speed V1 to 0 is included in the printing area PA. Therefore, compared to a case where none of the deceleration area GA is included in the printing area PA, the space needed for securing the deceleration area GA can be decreased, which contributes to the miniaturization of the ink jet printer 11.

(10) In a case where the distance between the paper P and the recording head 19 is the first distance, the carriage 18 and the engagement member 61 do not engage at the head opposing position x3. Therefore, in a case where the distance between the paper P and the recording head 19 is the first distance, when the carriage 18 is moved from the printing area PA to the head opposing position x3 to perform flushing during printing, the carriage 18 is moved to the head opposing position x3, without decelerating, at the first speed V1 which is the same speed as during the printing. Therefore, since the carriage 18 can be moved swiftly from the printing area PA to the head opposing position x3, a decrease in the throughput of the printing due to the periodic flushing performed during the printing can be suppressed.

(11) When capping of the recording head 19 is performed at the capping position by the cap member 52, since the carriage 18 is pressed to the cap member 52 side by the engagement member 61, capping of the recording head 19 by the cap member 52 can be performed regardless of the distance between the paper P and the recording head 19.

(12) When capping of the recording head 19 is performed at the capping position by the cap member 52, the posture of the carriage 18 can be stabilized by carriage 18 being pressed by the engagement member 61 to the cap member 52 side. Therefore, switching triggers for performing switching actions of various members can be arranged in the maintenance area MA through engagement with the carriage 18. As a result, space within the main body frame 12 can be saved, contributing to the miniaturization of the ink jet printer 11.

Modification Examples

Here, the embodiments described above may be changed to the following different embodiments.

In a case where the distance between the paper P and the recording head 19 is the first distance, it is not always necessary to move the carriage 18 from the printing area PA to the head opposing position x3 without decelerating the carriage 18. That is, the carriage 18 may be decelerated while moving between the printing area PA and the head opposing position x3.

A portion of the deceleration area GA that is an area in which the movement speed V of the carriage 18 decelerates from the first speed V1 to 0 in a case where the distance between the paper P and the recording head 19 is the second distance may not necessarily be included in the printing area PA.

In a case where the carriage 18 is decelerated in a state in which the distance between the paper P and the recording head 19 is the second distance, the movement speed V may be decelerated from the first speed V1 directly to the second speed V2.

The movement speed V when the carriage 18 moves from the head opposing position (flushing position) to the capping position may be faster for a case where the distance between the paper P and the recording head 19 is the first distance than the case of the second distance. In so doing, the throughput of the ink jet printer 11 can also be improved.

The switching trigger for performing the switching action of various members through engagement with the carriage 18 may be the engagement member, and the cap member (engagement plate 55*a*) engaging with the carriage 18 may be the engagement member.

In a case where the carriage 18 is at the capping position, the cap member 52 may be configured to be able to rise and fall between an abutting position of abutting the recording head 19 and a non-abutting position of being separated from the recording head 19 through a separate driving source.

The carriage 18 may be configured so that the height position is adjustable to two levels, three levels, or five or more levels through the cam member 38.

Instead of the paper P, a plastic film, linen, a metallic foil, or the like may be used as the target.

While the liquid ejecting apparatus is realized as the ink jet printer 11 in the embodiments described above, a liquid ejecting apparatus ejecting and discharging liquids other than ink may be adopted. The liquid ejecting apparatus may be replaced by various liquid ejecting apparatuses including a liquid ejecting head and the like discharging miniscule droplets. Here, a droplet is a liquid discharged from the liquid ejecting apparatus described above, and also includes those that are granular, teardrop-shaped, and those that leave a string-like trail. Further, the liquid referred to here may be any material that the liquid ejecting apparatus can eject. For example, the material may be any in a liquid state, including not only fluid bodies such as liquid bodies with high or low viscosity, sols, gels water, other inorganic solvents, organic solvents, solutions, liquid resins, and liquid metals (metallic melts) and liquids as one state of the material, but also those in which particles of the functional material formed of solids such as pigments and metallic particles are dissolved, dispersed, or mixed into a solvent, and the like. Further, typical examples of the liquid include the ink described in the embodiments described above, liquid crystals, and the like. Here, ink includes various liquid compositions such as generic water-based inks and oil-based inks, gel inks, and hot melt inks. Specific examples of the liquid ejecting apparatus include a liquid ejecting apparatus ejecting a liquid including, in the form of dispersion or dissolution, materials such as an electrode material or a color material used in the manufacture and the like of, for example, a liquid crystal display, an EL (Electroluminescence) display, a surface-emitting display, and a color filter, a liquid ejecting apparatus ejecting living organic matter used in the manufacture of biochips, a liquid ejecting apparatus used as a precision pipette ejecting a liquid as a sample, a printing apparatus, a micro dispenser, and the like. Furthermore, a liquid ejecting apparatus ejecting a lubricating oil with pinpoint accuracy onto a precision instrument such as a clock or camera, a liquid ejecting apparatus ejecting a transparent resin liquid such as an ultraviolet curable resin for forming a miniscule hemispherical lens (optical lens) used in optical communication elements and the like, or the like onto a substrate, or a liquid ejecting apparatus ejecting an etching liquid such as an acid or an alkali for etching a substrate or the like may be adopted. Furthermore, any one type of such liquid ejecting apparatuses can be applied to the embodiments of the invention.

The entire disclosure of Japanese Patent Application No.: 2011-188624, filed Aug. 31, 2011 is expressly incorporated by reference herein.

What is claimed is:

1. A liquid ejecting apparatus comprising:

a moving body supporting a liquid ejecting head that can eject a liquid onto a target that is supported on a support base from nozzles and is configured to be movable in a scanning direction;

a position adjustment mechanism adjusting a position of the moving body to adjust a distance between the support base and the liquid ejecting head to at least one of a first distance and a second distance, greater than the first distance;

a cap member configured to abut the liquid ejecting head to surround the nozzles; and an engagement member configured to engage with the moving body at a head opposing position side from a liquid ejecting area so as to bias the moving body towards the cap member when the moving body moves from the liquid ejecting area that is an area in which the liquid ejecting head can eject the liquid onto the target to the head opposing position that is a position opposing the cap member, wherein when the liquid ejecting head is at a position opposing the cap member, the position adjustment mechanism being configured to adjust the position of the moving body so that the distance between the support base and the liquid ejecting head changes between the first distance where the moving body does not engage with the engagement member when moving and the second distance where the moving body engages with the engagement member when moving.

2. The liquid ejecting apparatus according to claim 1, wherein in a case where the position adjustment mechanism adjusts the position of the moving body to the first distance, the moving body does not engage with the engagement member at a flushing position and engages with the engagement member at a capping position.

3. The liquid ejecting apparatus according to claim 1, wherein the moving body is decelerated while moving from the liquid ejecting area to the head opposing position, and a timing at which the moving body is decelerated is earlier in a case where the distance between the support base and the liquid ejecting head is the second distance than in the case of the first distance.

4. The liquid ejecting apparatus according to claim 3, wherein a movement speed of the moving body is decelerated to 0, and the position at which the movement speed of the moving body becomes 0 is further to the liquid ejecting area side in the case of the second distance than for the case of the first distance.

5. The liquid ejecting apparatus according to claim 1, wherein in a case where the moving body moves from the liquid ejecting area to the head opposing position, the movement speed at a position where the moving body opposes the engagement member is slower in a case where the distance between the support base and the liquid ejecting head is the second distance than in the case of the first distance.

6. The liquid ejecting apparatus according to claim 1, wherein in a case where the moving body is decelerated in a state in which the distance between the support base and the liquid ejecting head is the second distance, the movement speed is decelerated from a first speed to 0 before being accelerated to a second speed which is slower than the first speed.

7. The liquid ejecting apparatus according to claim 6, wherein in a case where the distance between the support base and the liquid ejecting head is the second distance, a portion of a deceleration area that is an area in which the movement speed of the moving body is decelerated from the first speed to 0 is included in the liquid ejecting area.

8. The liquid ejecting apparatus according to claim 3, wherein in a case where the distance between the support base and the liquid ejecting head is the first distance, the moving body is moved from the liquid ejecting area to the head opposing position without being decelerated.

9. The liquid ejecting apparatus according to claim 2, wherein the movement speed when the moving body moves from the flushing position to the capping position is faster in the case of the first distance than in the case of the second distance.

* * * * *